United States Patent [19]

Aujla

[11] 4,163,594

[45] Aug. 7, 1979

[54] ELECTRICAL CONNECTOR

[75] Inventor: Sharanjit S. Aujla, Whitby, Canada

[73] Assignee: International Telephone and Telegraph Company, New York, N.Y.

[21] Appl. No.: 928,999

[22] Filed: Jul. 28, 1978

[51] Int. Cl.[2] ..... H01R 13/54

[52] U.S. Cl. ..... 339/82; 339/177 R

[58] Field of Search ..... 339/82, 83, 89 C, 90 C, 339/177 E, 177 L, 37, 177 R, 217 S, 85

[56] References Cited

U.S. PATENT DOCUMENTS

| | | | |
|---|---|---|---|
| 3,519,979 | 7/1970 | Bodenstein | 339/85 |
| 3,646,495 | 2/1972 | Cowmeadow | 339/89 C X |
| 3,861,770 | 1/1975 | Horak | 339/85 X |
| 3,953,097 | 4/1976 | Graham | 339/85 X |
| 4,053,195 | 10/1977 | Laverick | 339/82 X |
| 4,068,911 | 1/1978 | Ladato | 339/90 C X |
| 4,138,181 | 2/1979 | Hacker | 339/90 C X |

*Primary Examiner*—Joseph H. McGlynn
*Assistant Examiner*—John S. Brown
*Attorney, Agent, or Firm*—A. Donald Stolzy

[57] ABSTRACT

A tamper-proof and theft-proof electrical connector including a termination unit with a hexagonal front portion internally threaded to be fitted to an externally threaded output terminal of a distributing source. The unit has a rear portion smaller in diameter than the front portion. An annular groove is provided in the rear portion, and a cylindrical clip is retained in the groove. The clip has leaf spring tines which have ends that are spaced from but extend outwardly and toward the front portion. A locking shield is then provided which covers the entire length of the termination unit. The locking shield has an annular portion to fit between the tines and the front portion. The locking shield can be removed with a tool that depresses the tines.

4 Claims, 8 Drawing Figures

ELECTRICAL CONNECTOR

BACKGROUND OF THE INVENTION

This invention relates to electrical connectors and more particularly to a theft-proof connector for terminating output terminals of distribution sources such a 'F' type fittings on directional taps, couplers, or similar devices, related to CATV applications.

The ever-increasing growth in the number of subscribers opting for cable television services especially in densely populated major metropolitan areas consisting of large apartment complexes and housing communities has resulted in an enormous increase in the installation of distribution sources or outlets providing a wide variety of exclusively transmitted entertainment by the cable companies.

Connections not authorized by the cable companies are frequently made. Unfortunately these connections are quite simply made to the easily accessible distribution outlets by occupants of dwellings. The occupants wish to obtain the benefits of cable service without paying. This presents the cable companies with a major problem of tracking such illegal taps and incorporating a positive means of prevention with a maximum cost saving.

PRIOR ART STATEMENT

U.S. Pat. No. 3,953,097 issued Apr. 27, 1978, incorporates restricted rotary motion and has coupling means for transmission of energy.

U.S. Pat. Nos. 3,861,770 issued Jan. 21, 1975, and 3,890,028 issued June b 17, 1975, again incorporate spring biased coupling means to transmit energy. They also require tools for installation.

U. S. Pat. No. 3,519,979 does not have a coupling member that is independent of the termination unit. The axial retention principle of the connector of the present invention is the exact opposite to that adopted in U.S. Pat. No. 3,158,424 issued Nov. 24, 1964.

See also U.S. Pat. No. 2,733,416 issued Jan. 31, 1956. See also U.S. Pat. No. 3,890,028 issued June 17, 1975.

SUMMARY OF THE INVENTION

In accordance with the connector of the present invention, the above-described and other disadvantages of the prior art are overcome by providing a new, improved and relatively inexpensive theft-proof terminator which is substantially tamper-proof and makes possible an efficient installation eventually resulting in a maximum cost saving to the cable companies.

In accordance with one feature of the connector of the present invention a construction is provided such that induced rotation of the termination unit is bidirectional and unrestricted. It is not removable from the distribution source to this extent. Any induced rotation of a shield, to be described, is bidirectional and unrestricted. Rotation of the termination unit is independent to the rotation of the shield.

In accordance with another feature of the present invention, there are no coupling means i.e. there is no induced transfer of energy whatsoever between the termination unit, coupling member, to be described, and shield. No spring members or complimentary co-acting parts are adopted to transmit torque or otherwise.

BRIEF DESCRIPTION OF THE DRAWINGS

In the accompanying drawings which illustrate exemplary embodiments of the present invention.

DESCRIPTION OF THE PREFERRED EMBODIMENT

The present invention includes a theft-proof terminator connector for output terminals on directional taps/-couplers and similar devices. This completely reusable theft-proof terminator connector essentially incorporates an adequate termination unit together with a means of preventing unauthorized tapping from output terminals of various distributing sources. Generally, the theft-proof terminator will be installed in-line between the output terminals and the plug on the tapping channel.

Figure 5:
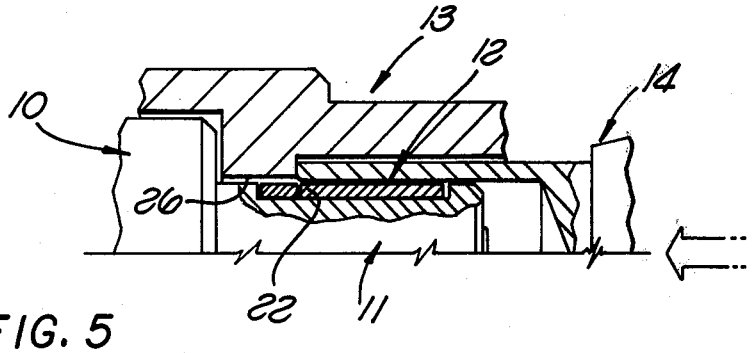
FIGS. 5 and 6 are broken-away sectional views of the connector of FIG. 4 being disassembled.
Figure 6:
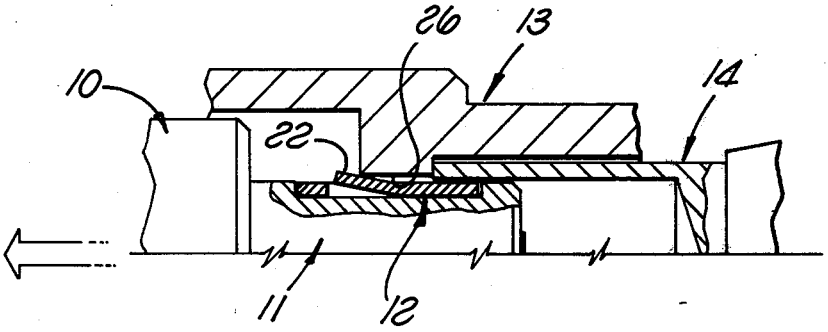
Figure 4:
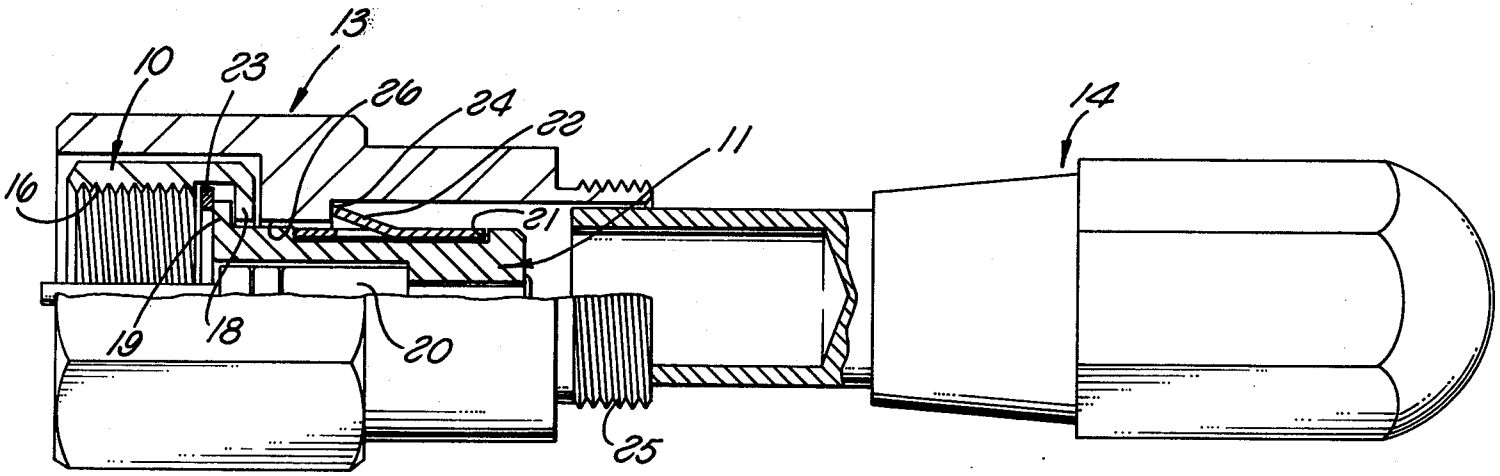
FIG. 4 is a sectional assembly, partly in elevation, of the connector shown in FIG. 1.

The present invention comprises a coupling member 10, a terminating collet 11, a retaining ring (snap ring) 15, retention clip 12 and a locking shield 13. A removal tool 14 is shown in FIGS. 4, 5 and 6.

Figure 1:
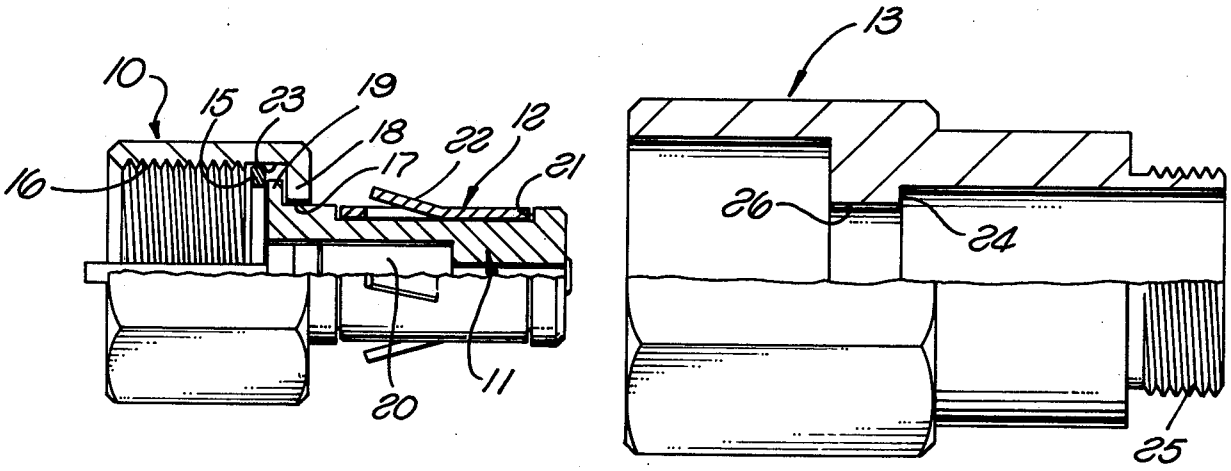
FIG. 1 is an exploded side elevational view, partly in section, of the electrical connector of the present invention.

In FIG. 1, coupling member 10 has a front portion provided with an internal thread 16 to permit connection to the outlet being terminated, and a reduced diameter bore 17 in the rear wall 18. The terminating collet 11 has a circular front flange 19 located within and retained by the rear wall 18 of the coupling member 10. In addition, the terminating collet 11 contains a centrally mounted load resistor 20.

Figure 2:
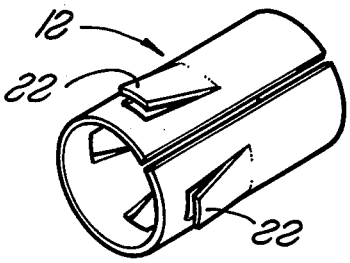
FIG. 2 is a perspective view of a retention clip shown in FIG. 1.
Figure 3:
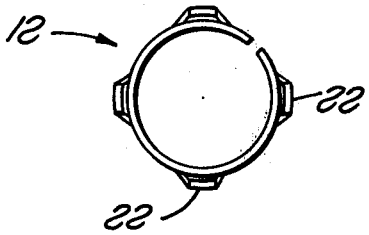
FIG. 3 is a left end elevational view of the clip shown in FIG. 2.

The retention clip 12 (see FIGS. 2 and 3) is mounted directionally in a cylindrical groove 21 provided on the rear portion of the terminating collet 11, such that leaf spring retaining fingers 22 of the retention clip 12 point towards the front circular wall 18.

The terminating collet 11 is assembled from the front of the coupling member 10 by inserting the rear portion of the terminating collet 11 through the bore 17 in the rear wall 18 of the coupling member 10 until the circular front-flange 19 is located against the rear wall 18 of the coupling member 10. Retaining ring 15 is then assembled from the front of the coupling member 10 and axially located adjacent to the circular front-flange 19 and within a groove 23 provided in the coupling member 10. The collet 11 is then locked to the coupling member 10.

The resultant termination unit is then installed on the output terminal of the distributing source while allowing the terminating collet 11 to rotate freely after assembly. The locking shield 13 is then axially pressed on to the termination unit until the retaining fingers 22 snap open behind a shoulder 24 provided on the inner surface of the shield. At the same time, the shield 13 can rotate freely around the termination unit. At this point, the locking shield 13 has completely enclosed the termination unit making it inaccessible to most readily available tools. It will therefore delay or prevent any unauthorized attempts to tamper with or to remove the termination unit assembly.

The locking shield 13, basically of a rugged construction and locked between wall 18 and fingers 22, will withstand high compressive loads and considerable axial loading in the removal direction. In addition to the above characteristics, the arrangement of both the locking shield 13 and the terminating collet 11 to independently rotate will delay or prevent any torsional or axial loading from being transferred to the coupling member 10.

The locking shield 13 also has a threaded portion 25 at the rear in order to facilitate connection to the tapping channel plug formerly connected to the outlet being terminated.

The removal tool 14 is of a selected diameter and cylindrical configuration. The removal of the theft-proof terminator system is accomplished by inserting the removal tool 14 through the opening in the rear of the locking shield 13 until it abuts against the shoulder 24 (FIG. 5) of the locking shield 13. In so doing, the removal tool 14 deflects the retaining fingers 22 of the retention clip 12 below a bore 26 of the locking shield 13 thereby permitting both the removal tool 14 and the locking shield 13 to be removed by sliding both together off of collet 11 (FIG. 6). The removal of the termination unit may then be initiated.

Figure 7:
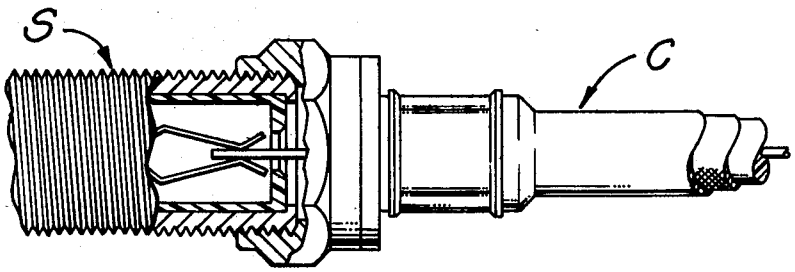
FIG. 7 is a side elevational view, partly in section, of an output terminal of a distributing source to a tapping channel.
Figure 8:
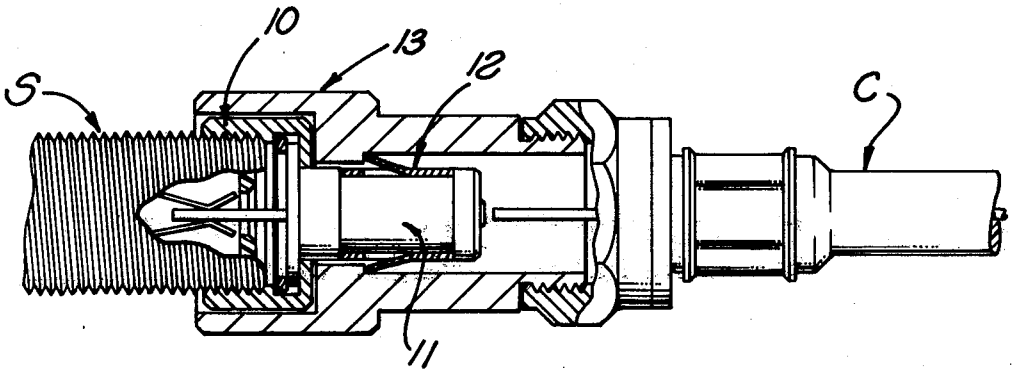
FIG. 8 is the structures of FIG. 7 with the electrical connector of the present invention connected therebetween.

Conventional fittings may be provided at S and C in FIG. 7. Fitting S may be a female "F" fitting. Fitting C is a male "F" fitting crimped to a coaxial cable. The connector of the present invention may be assembled between fittings F and C as shown in FIG. 8.

Advantages that can be derived from the present invention over prior art devices are as follows:

(a) Installation is accomplished without the aid of a special tool in a rapid and easy manner.

(b) The ability to separate the locking shield 13 and the termination unit assembly into independent parts provides freedom to use the latter as a basic terminator connector or in conjunction with the former as an efficient theft-proof and/or tamper-proof terminator connector.

(c) At the time of disassembly, both the removal tool 14 and the locking shield 13 slide axially along the principal axis. This feature is far superior to the costly, complex rotary motion now in use in the prior art.

(d) Installation and removal of the termination unit assembly is accomplished by direct manual threading as compared to the prior art which utilizes various rotary drive members to transfer the rotary motion via springs, washers and other drive surfaces.

(e) This invention may be used for CATV coaxial outlets or other terminating sources, the latter by changing or deleting the load resistor 20.

(f) The constituent components, e.g. locking shield 13, may be manufactured from either metallic or nonmetallic materials such as plastic, etc. Preferably, coupling member 10, ring 15, clip 12 and terminating collet 11 are made of metal.

(g) The lead of resistor 20 may be soldered or crimped to collet 11.

What is claimed is:

1. A tamper-proof electrical connector comprising: a termination unit including means at its forward end for connection with the output terminal of a distribution source, said unit having a cylindrical portion at its rearward end, said cylindrical portion having a groove and a shoulder at each end of the groove, said groove being positioned intermediate the ends of said portion; a cylindrical retaining clip snugly fitted around said portion between said groove shoulders and snugly in said groove so that said clip will abut said groove shoulders and will not slide off of said portion, said clip having leaf spring tines extending radially outwardly and forwardly of said unit, said unit having an external shoulder extending outwardly from and radially from said portion, said external shoulder being spaced a predetermined distance forwardly of the forward ends of said tines; and a locking shield having a bore, and first and second counterbores on each side of said bore, said first counterbore being deep enough to receive substantially the entire length of said unit forward of said portion, said first and second counterbores terminating in first and second shoulders spaced apart somewhat less than said predetermined distance, said bore having a diameter such that said locking shield is slidable on and positioned on said portion and such that said bore lies between and is locked between said unit shoulder and the ends of said tines with said first shoulder approximately abutting said unit shoulder and said tines approximately abutting said second shoulder.

2. The invention as defined in claim 1, wherein said locking shield is removable from said unit portion by moving a hollow cylinder inside said second bore between said portion and said shield, depressing said tines, and moving said shield and said hollow cylinder rearwardly.

3. The invention as defined in claim 2, wherein electrical means are carried by said unit.

4. The invention as defined in claim 1, wherein electrical means are carried by said unit.

* * * * *

UNITED STATES PATENT OFFICE

CERTIFICATE OF CORRECTION

PATENT NO. : 4,163,594

DATED : August 7, 1979

INVENTOR(S) : Sharanjit S. Aujla

It is certified that error appears in the above-identified patent and that said Letters Patent are hereby corrected as shown below:

On the Abstract page, replace "International Telephone and Telegraph Company" with --International Telephone and Telegraph Corporation-- as the assignee.

Signed and Sealed this

*Eleventh* Day of *March 1980*

[SEAL]

*Attest:*

SIDNEY A. DIAMOND

*Attesting Officer*

*Commissioner of Patents and Trademarks*